United States Patent [19]

Sauda et al.

[11] Patent Number: 4,661,290

[45] Date of Patent: Apr. 28, 1987

[54] APPARATUS FOR COMPACTING SOLID WASTE MATERIALS AND ITS ACCESSORY FACILITIES

[75] Inventors: Kenzo Sauda; Akitoshi Yokota; Takuro Yagi; Hiroshi Kuribayashi, all of Kanagawa; Saburo Kita, Tokyo; Setsuo Shibata, Kanagawa; Hirofusa Ogawa, Tokyo, all of Japan

[73] Assignee: JGC Corporation, Tokyo, Japan

[21] Appl. No.: 731,372

[22] Filed: May 7, 1985

[30] Foreign Application Priority Data

| | | | |
|---|---|---|---|
| Mar. 15, 1984 | [JP] | Japan | 59-50607 |
| May 18, 1984 | [JP] | Japan | 59-98637 |
| Jun. 24, 1984 | [JP] | Japan | 59-130980 |
| Jun. 27, 1984 | [JP] | Japan | 59-130978 |
| Jun. 27, 1984 | [JP] | Japan | 59-130979 |

[51] Int. Cl.[4] ..... G21F 9/00; G21F 9/36; B30B 15/34

[52] U.S. Cl. ..... 252/626; 100/38; 100/41; 100/93 R; 252/628; 252/633; 264/320; 425/DIG. 116; 425/DIG. 243; 425/DIG. 245; 425/DIG. 246

[58] Field of Search ..... 252/626–632, 252/628, 633; 264/0.5, 21, 239, 319, 320, 327, DIG. 65; 110/223, 237; 100/41, 38, 92, 93 R; 425/357–360, 377, 378 R, 472, DIG. 116, DIG. 243, DIG. 245, DIG. 246, DIG. 227; 148/132

[56] References Cited

U.S. PATENT DOCUMENTS

| | | | |
|---|---|---|---|
| 3,956,981 | 5/1976 | Pitt | 100/41 |
| 3,991,668 | 11/1976 | De Milt et al. | 100/98 R |
| 4,184,959 | 1/1980 | Marmo | 252/626 |
| 4,238,998 | 12/1980 | Herring et al. | 100/41 |
| 4,311,531 | 1/1982 | Bege | 252/626 |

FOREIGN PATENT DOCUMENTS

| | | | |
|---|---|---|---|
| 3116666 | 11/1982 | Fed. Rep. of Germany | 252/626 |
| 0000400 | 1/1978 | Japan | 252/626 |
| 0128498 | 7/1984 | Japan | 252/626 |
| 0220696 | 12/1984 | Japan | 252/626 |
| 0517798 | 2/1940 | United Kingdom . | |
| 1528478 | 10/1978 | United Kingdom | 252/626 |

*Primary Examiner*—Stephen J. Lechert, Jr.
*Assistant Examiner*—Howard J. Locker
*Attorney, Agent, or Firm*—Edmund M. Jaskiewicz

[57] ABSTRACT

An apparatus for compacting a solid waste material includes a hollow cylindrical body having a charging inlet for charging the solid waste material therethrough into the hollow cylindrical body, a heating portion for heating the solid waste material in the hollow cylindrical body, and a discharging outlet for discharging the solid waste material from the hollow cylindrical body; a rotatable shaft disposed in the hollow cylindrical body and having a helical screw blade thereon, the screw blade and an inner wall surface of the hollow cylindrical body being spaced from each other with a clearance provided therebetween for allowing the solid waste material in the hollow cylindrical body to form a bridge therein; a support for radially movably supporting an end of the rotatable shaft; a prime mover coupled to the end of the rotatable shaft through the support; and an outlet nozzle coupled to the discharging outlet for compressing the solid waste material discharged from the discharging outlet. The compacting apparatus can compact various solid waste materials including plastics discharged from homes, factories, nuclear power plants, and other facilities, and compacted solid waste materials can be solidified into solid masses or pelletized.

23 Claims, 12 Drawing Figures

APPARATUS FOR COMPACTING SOLID WASTE MATERIALS AND ITS ACCESSORY FACILITIES

BACKGROUND OF THE INVENTION

The present invention relates to an apparatus for reducing the volume of various solid waste materials discharged from homes, factories, nuclear power plants, for example, to produce compacted solid masses for landfill or storage, to such an apparatus further comprising its accessory facilities and also to a method for cleaning said apparatus.

Various solid waste materials are discharged from homes, factories, power plants, and other facilities of today. For example, solid wastes such as pieces of plastics, metal, glass, and other materials are discharged from homes and factories, and radioactive wastes such as rags, polyethylene sheets, paper, concrete pieces, steel members, high-performance filters, heat insulation are discharge from nuclear power plants. The aforesaid solid wastes discharged from homes and factories are processed in different ways, which raise their own problems. For example, the discharged pieces of plastics are burned in incinerators. However, the incinerators tend to be melted by heat generated by burning of plastics, clogged by the molten plastics and damaged by local overheating. Furthermore, the incinerators produce harmful gases such as chlorine and dioxin. Landfill of polystyrene foam pieces, polyethylene sheets, plastics bags is disadvantageous in that since these materials are bulky, the cost of transportation thereof is high, and they tend to be exposed onto the landfill surface after buried and then scattered due to winds, resulting in environmental pollution. Various methods have been proposed to recover and reuse waste plastics for effective exploitation of resources. However, since urban trash includes a wide variety of materials, it is more costly to classify the different trash materials than to recover the waste plastics.

It has been proposed in Japanese Patent Publication No. 57-11273 to produce large solid masses containing inorganic particles fixed together with a melt of thermoplastic waste materials by adding a granular or particulate inorganic material such as sand, crushed stone, or ash to the thermoplastic waste materials under heat. This process is however not suitable to granulate metals, fabric pieces and the like, and hence is required to be effected after the metals, fabrics and the like have been separated from the other materials.

The wastes contaminated by a radioactive material in nuclear power plants are normally packed in polyvinyl bags which are placed in drum cans for storage, sometimes after having been classified into combustible and noncombustible materials.

Waste materials such as high-performance filters composed of a wood material, a filter aid (inorganic), a metal plate and the like which are joined together are required to be disassembled into individual parts which should then be sorted. This process is complicated and gives the workers a greater chance to get exposed to radiation.

The drum cans are stored in storage houses. Since the available storage spaces in the storage houses are becoming smaller than expected these days, the combustible radioactive wastes are burned and the produced ash is stored in drum cans or mixed with cement and solidified as stable solid masses. The burning process is used for processing the bulky materials such as polyethylene sheets, polyvinyl bags, rags and paper wastes, and hence is capable of reducing the volumes of these waste materials. For this reason, the burning process is widely employed to process the waste materials discharged from nuclear power plants, facilities using radioisotopes, and other similar facilities.

However, when a large quantity of plastic materials are burned in an incinerator, the incinerator is liable to get damaged, and the incinerator system is required to be equipped with an exhaust gas processing apparatus which itself produces a secondary waste material. In addition, the cost of installation of said apparatus is high.

Another process of treating radioactive solid waste materials is to employ a press for compacting the wastes into smaller volumes. There is developed a high-pressure compacting apparatus for compacting waste materials under a pressure ranging from 1000 to 3000 $kg/cm^2$. According to this compacting process, polyethylene sheets, polyvinyl bags, paper wastes, rags and similar waste materials can be compacted into masses free of free spaces or air pockets trapped therein. Although the compacting process is one of effective methods, produced compacted masses are combinations of heterogeneous materials that are not desired for a long-term storage.

SUMMARY OF THE INVENTION

It is an object of the present invention to provide an apparatus for compacting solid waste materials discharged from homes and factories or radioactive solid waste materials discharged from nuclear power plants and facilities using radioisotope, to solidify the waste materials into masses which can be pelletized, stuffed into drum cans, or shaped into prismatic forms for stable landfill or storage, without producing secondary waste materials.

Another object of the present invention is to provide such an apparatus further comprising an accessory facility for stably controlling the operation of the foregoing compacting apparatus.

Still another object of the present invention is to provide such an apparatus further comprising an accessory facility for shaping materials extruded from the foregoing compacting apparatus, cutting off the shaped materials, and charging the cut-off materials into containers.

A still further object of the present invention is to provide such an apparatus further comprising an accessory facility for processing an exhaust gas from the foregoing compacting apparatus for use as effective cooling means without requiring extra equipment and producing unwanted secondary waste materials.

A yet still further object of the present invention is to provide such an apparatus further comprising an accessory facility for cleaning the foregoing compacting apparatus without requiring extra equipment and producing unwanted secondary waste materials.

According to the present invention, there is provided an apparatus for compacting a solid waste material, comprising a hollow cylindrical body having a charging inlet for charging the solid waste material therethrough into the hollow cylindrical body, a heating portion for heating the solid waste material in the hollow cylindrical body, and a discharging outlet for discharging the solid waste material from the hollow cylindrical body; a rotatable shaft disposed in the hollow cylindrical body and having a helical screw blade thereon, the screw blade and an inner wall surface of the hollow cylindrical body being spaced from each other with a clearance provided therebetween for allowing the solid waste material in the hollow cylindrical body to form a bridge therein; support means for radially movably supporting an end of the rotatable shaft; a prime mover coupled to the end of the rotatable shaft through the support means; and an outlet nozzle coupled to the discharging outlet for compressing the solid waste material discharged from the discharging outlet. The compacting apparatus can compact various solid waste materials including plastics discharged from homes, factories, nuclear power plants, and other facilities, and compacted solid waste materials can be solidified into solid masses or pelletized. The solidified masses produced by the compacting apparatus are coated with plastics, and can be buried directly if they are derived from urban trash. Harmful metals contained in dry cells and other discarded devices are confined in the solidified masses to guard against environmental pollution. Since the solid waste materials are processed in a confined spaced at a temperature below 280° C., mercury contained in dry cells and the like and dioxin are not discharged from the compacting apparatus. The exhaust gas from the compacting apparatus can easily be processed as only the charging inlet is open. If radioactive solid waste materials are so small in quantity that they are negligible depending on the amount and type of the nuclide, they can be stuffed into a drum can or container which can be buried. The solid waste material as it is pelletized and stored in drum cans can finally be melted. The compacting apparatus of the invention can be carried on a truck or otherwise mobilized so that it can be moved to a desired processing location. If a chopper is disposed in or near the charging inlet such as a hopper of the hollow cylindrical body, then the conventional supply device composed of a chopper and a conveyor can be dispensed with, and the overall apparatus is compact in size. For processing radioactive solid waste materials, the compacting apparatus is useful in preventing environmental pollution.

According to the present invention, the compacting apparatus may further comprise an accessory facility for controlling rotation of the rotatable shaft depending on a current flowing through the prime mover or a torque imposed on the prime mover. With this controlling method, the screw blade and the prime mover such as a motor can be prevented from being damaged or broken and can be continuously operated safely when the solid waste material is compacted.

According to the present invention, the compacting apparatus may further comprise an accessory facility for producing a solid mass comprising a plurality of shaping tubes into each of which an extruded mass from the compacting apparatus can be forcibly charged; means for closing one of the shaping tubes at a time when the extruded mass is charged into said shaping tube; means for moving over the shaping tubes; and means for ejecting the extruded mass out of said one shaping tube. The method of producing a solid mass by the use of the accessory facility may comprise the steps of positioning a shaping tube with an end thereof opening toward the discharging outlet; closing an opposite end of the shaping tube with closing means; forcibly charging an extruded mass from the apparatus into the shaping tube; thereafter rotating the rotatable shaft in a reverse direction to cut off the extruded mass in the vicinity of the discharging outlet; moving over the shaping tube filled with the extruded mass to cool the same; and ejecting the shaped and cooled extruded mass out of the shaping tube. With the above producing facility and method, well shaped solid masses are successively produced at a constant rate, and can automatically be treated to thereby save labor power. For processing radioactive waste materials, the automatic treatment of the solid masses is effective in preventing workers from being exposed to radioactivity. The cost of the facility is low since it is not necessary to add a special cutter for cutting the extruded mass.

According to the present invention, the compacting apparatus may further comprise an accessory facility for processing an exhaust gas discharged from the compacting apparatus, the processing method comprising the steps of filtering the exhaust gas produced by the apparatus to collect dust particles therefrom; thereafter discharging the exhaust gas through an exhaust gas line; and cooling a cooling medium for an induction heating coil for heating the heating portion, with the exhaust gas in a heat exchanger disposed on the exhaust gas line. According to this exhaust gas processing method, the exhaust gas produced when compacting the solid waste material is used for cooling the cooling medium for the induction heating coil, and hence no extra equipment such as conventional cooling tower and fan coil is not required. A fan used in the gas processing system is employed both to discharge the exhaust gas and to cool the cooling medium, and hence is an energy saver. The dust particles collected by the filter used in the gas processing system can be processed by the compacting apparatus without producing an undesired secondary waste material.

According to the present invention, there is further provided a method for cleaning the compacting apparatus, the method comprising the step of charging a cleaning material into the hollow cylindrical body to force a remaining solid waste material out of the hollow cylindrical body. Since no other materials than the solid waste material and sand as the cleaning material, the remaining solid waste material can be cleared away without producing a secondary waste material and without requiring additional cleaning equipment. Therefore, the compacting apparatus is inexpensive and can easily be operated for cleaning. The cleaning process can prevent a reduction of the compacting efficiency due to melted plastics deposited in the apparatus.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

A compacting apparatus according to the present invention will be described with reference to FIGS. 1 through 3.

Figure 1:
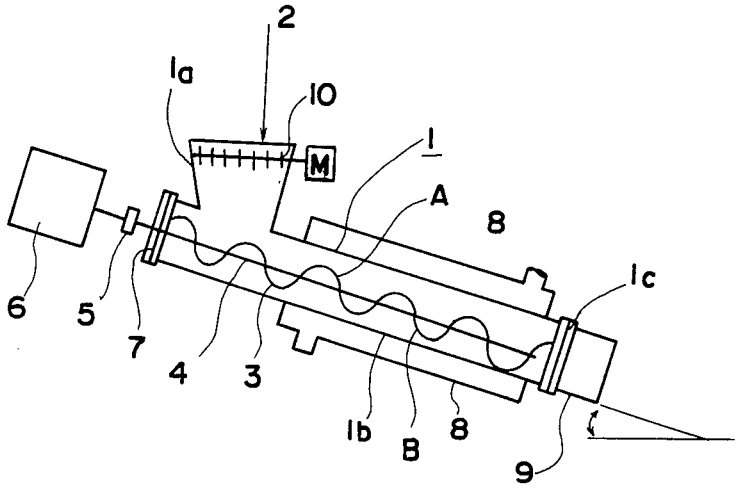
FIG. 1 is a schematic elevational view of a compacting apparatus according to the present invention.

As shown in FIG. 1, the compacting apparatus includes a hollow cylindrical body 1 having a waste charging hopper 1*a*, a heating portion 1*b*, and a waste outlet 1*c*, and a rotatable shaft 4 disposed in the hollow cylindrical body 1 and having a helical screw blade 3. The hollow cylindrical body 1 is tilted downwardly toward the waste outlet 1*c* at an angle smaller than the angle of repose of a solid waste 2 including a plastic material in order to effectively feed, crush, grind, mix, compress the solid waste 2. The rotatable shaft 4 has its upper end connected to a prime mover 6 such as a motor through a coupling 5 with its axis radially swingable. The rotatable shaft 4 is rotatably supported by a freely movable bearing 7. Between the inner wall surface of the hollow cylindrical body 1 and the screw blade 3, there is a clearance for allowing the solid waste 2 to form a bridge between the inner wall surface of the cylindrical body 1 and the screw blade 3, the clearance being in the range of from 5 to 20 mm when the shaft 4 and the cylindrical body 1 are coaxial.

Figure 2:
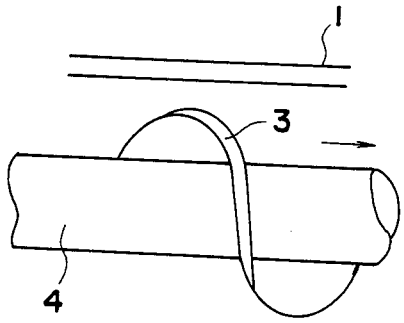
FIG. 2 is a fragmentary elevational view of a hollow cylindrical body housing a screw conveyor therein.

As shown in FIG. 2, the screw blade 3 has its substantially half distal end portion inclined at 10 to 30 degrees toward the upper end of the rotatable shaft 4 in a region between the waste charging hopper 1*a* and the heating portion 1*b*. The screw blade 3 thus constructed can effectively stir, mix, and crush the solid waste 2.

Figure 3:
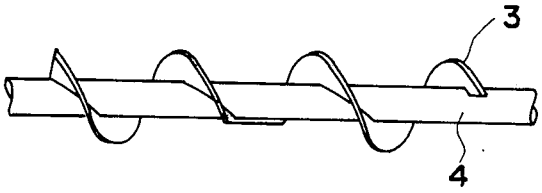
FIG. 3 is a fragmentary elevational view of a screw conveyor with a blade-free portion.

As shown in FIG. 3, the screw blade 3 has at least one recess to discharge a gas (air or water vapor) trapped when the solid waste 2 is charged or produced when the solid waste 2 is processed, so that the solid waste 2 can efficiently be fed and crushed. A waste outlet nozzle 9 is attached to the waste outlet 1*c* of the hollow cylindrical body 1 for compacting the solid waste 2 which has been ground and uniformized with plastic and rubber melted, into a firm solid mass or body. The waste outlet nozzle 9 may be integral with the hollow cylindrical body 1, and has substantially the same diameter as the inside diameter of the cylindrical body 1. Preferably, the nozzle 9 has a polygonal cross section such as a square or a hexagon, or a circular cross section. The nozzle 9 may have an inner wall provided with projections or a roughened surface for promoting the compression of the solid waste 2.

A method of compacting the solid waste 2 by the compacting apparatus will be described with reference to FIG. 1.

The solid waste 2 including a plastic material is charged into the hollow cylindrical body 1 through the hopper 1*a* by means of a conveyor such as a belt conveyor (not shown). The compacting apparatus has a chopper 10 for chopping the solid waste 2 as it is charged into small pieces. Therefore, the compacting apparatus can process different kinds of solid wastes, can easily control the amount of the solid waste which is charged into the cylindrical body 1, and can be small in overall size. With the chopper 10 employed, it is not necessary to convey chopped pieces to the hopper 1*a* and hence the solid waste 2 is prevented from being scattered around when it is conveyed toward the hopper 1*a*.

The charged solid waste 2 is progressively fed toward the heating portion 1*b* by the screw blade 3 on rotation of the rotatable shaft 4. Since the cylindrical body 1 is tilted as described above, the solid waste 2 can smoothly be fed along. If the cylindrical body 1 were tilted at an angle less than 5 degrees, the solid waste 2 as melted would be subjected to an excessive resistance dependent on the type and condition of the solid waste 2, with result that an undue load would be imposed on the motor 6 and the apparatus might be broken or damaged. If the cylindrical body 1 were tilted at an angle larger than 30 degrees, the solid waste 2 would be formed into insufficient bridges, resulting in insufficient crushing, grinding and mixing of the solid waste 2, and solid masses would not be produced well.

The substantially half distal end portion of the screw blade 3 is inclined in a direction opposite to the direction in which the solid waste 2 is fed, i.e., toward the upper end of the rotatable shaft 4, and the screw blade 3 has at least one recess. With this arrangement, the solid waste 2 can efficiently be fed, crushed, and ground. The length of the screw blade 3 should be selected such that when the shaft 4 rotates at a speed lower than a certain speed, the solid waste 2 is not discharged in a constant quantity. With the screw blade 3 being of a certain length, therefore, the velocity of rotation of the shaft 4 should be higher than the minimum velocity of rotation at which the solid waste 2 can be discharged in a constant quantity.

The crushed and ground solid waste 2 is converted into a uniformly mixed mass in the heating portion 1*b* since the thermoplastic material and rubber in the solid waste 2 are melted in the heating portion 1*b*. The heating portion 1*b* is heated up to a temperature ranging from 200° to 280° C. by a suitable heating means 8 for applying hot air, for example. When the heating portion 1*b* is thus heated, the temperature within the heating portion 1*b* ranges from 160° to 250° C. In this temperature range, the plastic material and rubber are melted, but no gas is given off, and the paper is not burned. Since the solid waste 2 is moved in the closed space in the cylindrical body 1, the amount of air present therein is small, and no explosion takes place. The heating means 8 may be composed of a heating medium, an electric heater, a water vapor heater, or an induction heater, for example.

The structures that the clearance is present between the inner wall surface of the hollow cylindrical body 1 and the screw blade 3 for producing a bridge of the solid waste 2 therein, and the cylindrical body 1 is inclined downwardly are not derived from the screw feeder. If a large clearance were present in the screw feeder at the time of feeding a granular or powdery material, the clearance would serve as a dead space to produce a material bridge therein, which could not be fed along. According to the present invention, the upper end of the rotatable shaft 4 is supported by the freely movable bearing 7 and coupled through the radially swingable support means or coupling 5 to the motor 6. In operation, the shaft 4 rotates while being eccentrically moved radially (i.e., the shaft 4 has not fixed axis of rotation), so that the solid waste 2 is crushed by the screw blade 3. Although the solid waste 2 forms a bridge temporarily in the clearance, it is heated due to collision and friction and hence can be crushed and ground. The heating of the solid waste 2 is an energy saver since the amount of heat applied by the heating portion 1*b* may be reduced.

Since the waste 2 in the heating portion 1*b* is heated to 160° through 250° C. by the external heat applied thereto, the plastics and rubber of the crushed waste material 2 are melted and permeate the paper waste, heat insulation and other materials, which are uniformly mixed together and fed downwardly. The melted and mixed waste is then brought to a stop when it arrives at the lower end of the hollow cylindrical body 1, i.e., the waste outlet 1*c*, but is forced into the outlet nozzle 9 by the following melted and mixed waste. Inasmuch as the waste is cooled in the outlet nozzle 9, the melted plastics is solidified, and compressed due to frictional resistance between the inner wall surface of the outlet nozzle 9 and the waste, thus forming a solid mass or body. The outlet nozzle 9 should preferably be of the same diameter as that of the cylindrical body 1 as described above, but may be of a smaller inside diameter. If the diameter of the outlet nozzle 9 were too large, the melted and mixed waste would not sufficiently be compressed, and if the diameter of the outlet nozzle 9 were too small, the frictional resistance would be too large so that the screw blade 3 would be damaged or broken due to forced rotation thereof. The outlet nozzle 9 may be replaced with a plastic molding die and a cutter for producing pellets of the waste material.

A method of controlling the operation of the compacting apparatus by the use of the accessory controlling facility will be described.

The solid waste 2 is crushed, ground, and mixed by being jammed between the screw blade 3 and the inner wall surface of the cylindrical body 1, and the compacting apparatus is capable of continuous operation since the shaft 4 is radially displaceable. However, the screw blade 3 may be twisted or damage due to a massive jam, or the motor 6 may be subjected to an overload, so that the compacting apparatus will have to be shut off.

The controlling method of the invention is effective in solving the above problems. More specifically, when the current flowing through the motor or the torque imposed on the motor exceeds a prescribed level and continues for a certain period of time, the shaft 4 is rotated in a reverse direction. When such a condition occurs, it is most likely for the solid waste 2 to be jammed between the screw blade 3 and the inner wall surface of the cylindrical body 1. If the condition continues, the motor may be subjected to a burnout or the screw blade 3 may be broken or damaged. To prevent this, when the motor current or torque reaches the preset level and continues for the given time interval, the motor 6 is reversed to release the jammed solid waste 2. When the motor 6 is rotated in the normal direction upon elapse of a certain time, therefore, the motor current or torque restores its normal level.

Figure 4:
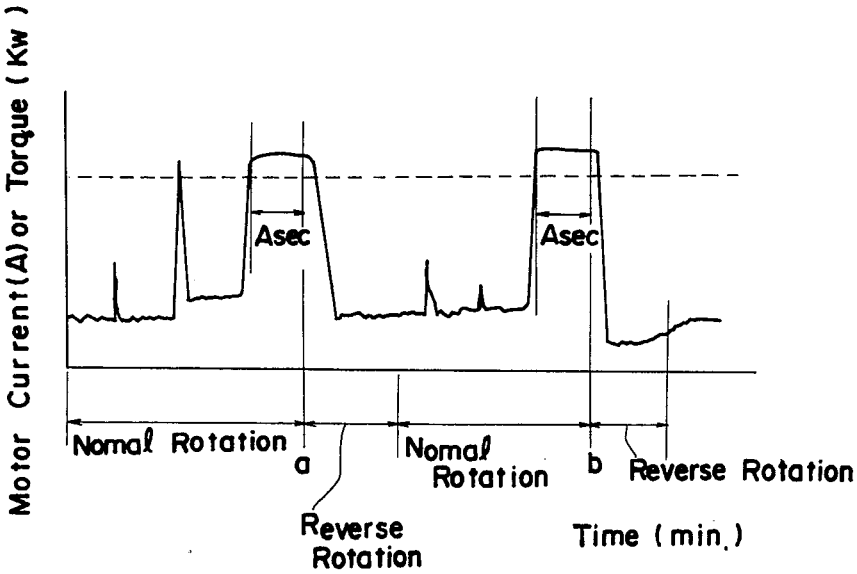
FIG. 4 is a graph showing the relationship between time intervals in which a motor rotates in normal and reverse directions and a motor current or torque.

FIG. 4 shows that the motor is reversed at points a and b upon elapse of a prescribed time (A sec) after the motor current or torque has reached a preset value and continued for a prescribed period of time, i.e., for the time short enough for the motor 6 or the screw blade 3 not to be damaged. By reversing the motor 6 in this manner, the motor 6 and the screw blade 3 are not subjected to an overload, and will not be broken or damaged.

As an alternative control method, the occurrences of reversing of the shaft 4 are counted, and the shaft 4 is brought to a stop when the counted occurrences reach a prescribed count within a preset period of time. Stated otherwise, since the reversal of the shaft 4 is required under an abnormal condition in which the solid waste 2 is jammed, the apparatus should be shut off and inspected when the shaft 4 is frequently reversed.

In the controlling method of the invention, the chopper 10 should also be stopped when the shaft 4 is stopped.

An accessory facility for and a method for producing a solid mass or body from a solid waste material according to the present invention will be described hereinbelow.

The compacted mass extruded from the compacting apparatus is shaped as it passes through the waste outlet 1*c* and is forced into the outlet nozzle 9 while it is gradually being cooled. If the outlet nozzle 9 were too short, the compressive force imposed on the extruded mass would be released due to the residual heat, and the extruded mass would tend to be expanded at the outlet of the outlet nozzle 9. Conversely, if the outlet nozzle 9 were too long, the apparatus would not be made compact in size, and the extruded mass would be subjected to a greater resistance in the outlet nozzle 9, thus requiring an increased amount of power from the motor 6.

Since the extruded mass produced by compacting the solid waste material 2 is highly viscous, a suitable cutting means is required to cut the extruded mass off the outlet of the compacting apparatus. The cutting means may comprise a mechanical cutter or saw, which however is not preferred because of its complex construction. In the event that the waste material is radioactive, radioactive particles would be produced if the extruded mass were cut off by the mechanical cutting means.

The aforesaid problems can be solved by the method and facility for producing a solid mass, associated with the compacting apparatus. The method and facility for producing a solid mass will be described with reference to FIGS. 5 through 8.

Figure 5:
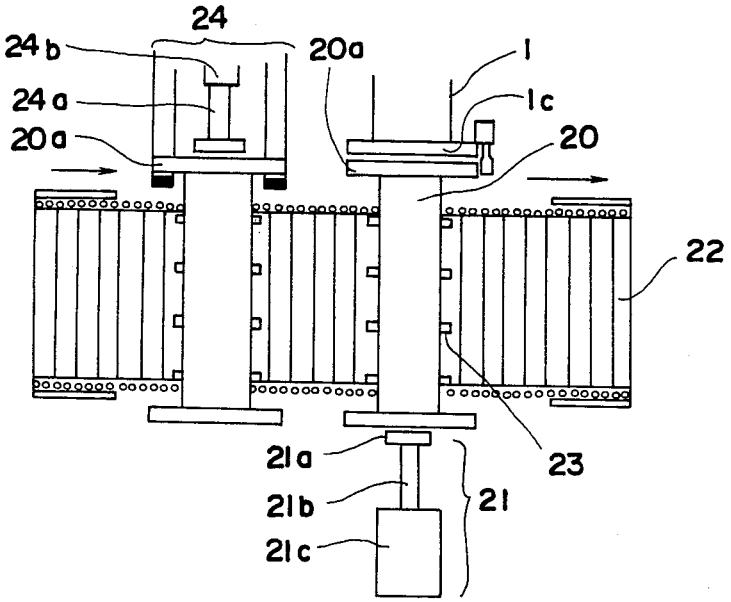
FIG. 5 is a front elevational view of an accessory facility for producing solid masses from solid waste materials.
Figure 6:
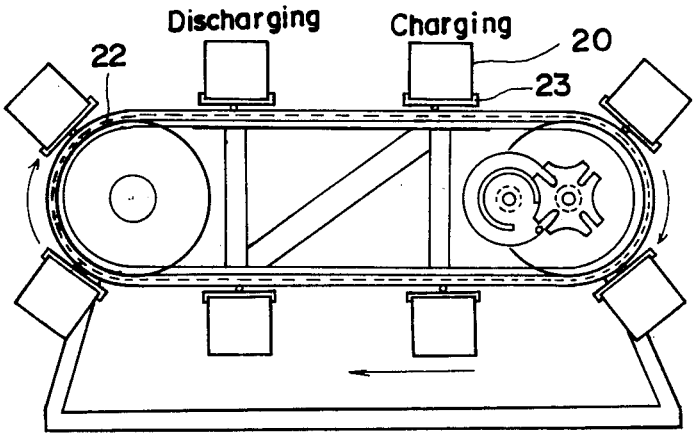
FIG. 6 is a side elevational view of the facility shown in FIG. 5.
Figure 7:
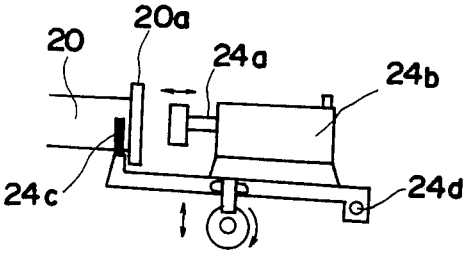
FIG. 7 is a side elevational view of a means for discharging an extruded mass.
Figure 8:
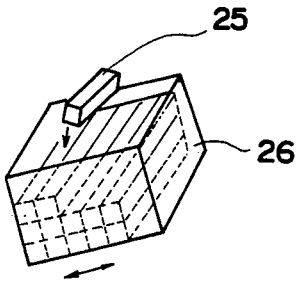
FIG. 8 is a view illustrative of the manner in which solid masses are charged into a container.

As illustrated in FIGS. 5 through 7, the facility for producing a solid mass from a solid waste material includes a shaping tube 20 into which an extruded mass discharged from the compacting apparatus is forced, the shaping tube 20 having a flanged end 20*a*, and a tube closing assembly 21 for closing one end of the shaping tube 20 when the extruded mass is forced into the shaping tube 20 from the flanged end 20*a*, the tube closing assemby 21 being composed of a presser plate 21*a* having an outer peripheral shape substantially identical to the inner peripheral surface of the shaping tube 20, a piston 21*b* on which the presser plate 21*a* is mounted, and a fluid cylinder 21*c* for moving the piston 21*b* under a prescribed pressure. The shaping tube 20 is fixed to a belt conveyor 22 by means of attachments 23. The apparatus also includes an ejector assembly 24 composed of an ejector piston 24*a* and a fluid cylinder 24*b* for moving the ejector piston 24*a*.

Before a solid waste material is compacted, the shaping tube 20 is disposed in place of the outlet nozzle 9 so that the flanged end 20*a* of the shaping tube 20 opens toward the outlet 1*c* of the cylindrical body 1. To prevent an extruded mass from leaking from the gap between the outlet 1*c* and the shaping tube 20, the flanged end 20*a* should firmly be attached to the outlet 1*c* preferably by detachable fasteners such as bolts and nuts or clamps. Since the outlet 1*c* is inclined downwardly at an angle smaller than the angle of repose of the solid waste material, the shaping tube 20 should also be inclined in coaxial relation to the outlet 1*c*. The shaping tube 20 should preferably be of a rectangular cross section to facilitate the subsequent charging of solid mass into a container. A plurality of such shaping tubes should be provided for successive production of solid masses.

Then, the shaping tube 20 is closed fully across its cross section by the tube closing assembly 21. The piston 21*b* is movable through a stroke longer than the length of the shaping tube 20. The piston 21*b* can be moved through the shaping tube 20 by the fluid pressure 21*c* under a fluid pressure depending on the type of the solid waste (extruded mass). The presser plate 21*a* may be positioned anywhere in the shaping tube 20 depending on the pressure which bears the presser plate 21*a*. However, the presser plate 21*a* should preferably be positioned at the flanged end 20*a* of the shaping tube 20 since the presser plate 21*a* can be pushed back against the pressure of the fluid cylinder 21*c* as the extruded mass is forced into the shaping tube 20, so that the extruded mass can uniformly stuffed into the shaping tube 20.

After the shaping tube 20 and the tube closing assembly 21 have been positioned, the compacting apparatus is operated to extrude a compacted solid paste by the screw blade 3 into the shaping tube 20 under a certain pressure. Where the presser plate 21*a* is initially positioned closely to the flanged end 20*a*, the presser plate 21*a* is gradually pushed back when the pressure of the extruded mass exceeds the pressure under which the presser plate 21*a* is supported by the fluid cylinder 21*c*. When the presser plate 21*a* is pushed to the end of the shaping tube 20 near the tube closing assembly 21, the compacting operation is interrupted.

After the extruded mass has been charged into the shaping tube 20, the shaft 4 of the compacting apparatus is rotated in the opposite direction to cut off the extruded mass in the vicinity of the outlet 1*c*. The extruded mass can easily be cut off since it has a relatively high viscosity.

Then, the shaping tube 20 with the extruded mass contained therein is detached from the outlet 1*c*, and moved over by the conveyor 22. Since the shaping tube 20 is secured to the belt conveyor 22 by the attachments 23, it does not fall off the belt conveyor 22 when it is positioned below the belt conveyor 22 as shown in FIG. 6. The belt conveyor 22 may be inclined to keep the shaping tube 20 in coaxial alignment with the inclined outlet 1*c*.

The extruded mass filled in the shaping tube 20 is cooled while the shaping tube 20 is moved over by the belt conveyor 22. Inasmuch as the extruded mass is sufficiently cooled until the shaping tube 20 reaches the ejector assembly 24, the extruded mass in the shaping tube 20 is shrunk and solidified into a solid mass, and can hence easily be pushed off the shaping tube 20. When the shaping tube 20 reaches the ejector assembly 24, the flanged end 20*a* is fixed in position by a locking device 24*c* pivotally supported by a pivot shaft 24*d*. Then, the fluid cylinder 24*b* is actuated to push the piston 24*a* to eject the solid mass out of the shaping tube 20.

The ejected solid mass falls onto a handling table (not shown). A certain number of such ejected solid masses are bundled on the handling table, and then closely packed in a rectangular container. Where the shaping tube 20 is of such a cross section as to allow ejected solid masses to be closely packed in the container, the solid masses 25 (FIG. 8) may directly be loaded into the container 26 in a closely packed combination.

A method of processing an exhaust gas by the use of the exhaust gas processing facility for operating the compacting apparatus smoothly will hereinafter be described.

Figure 9:
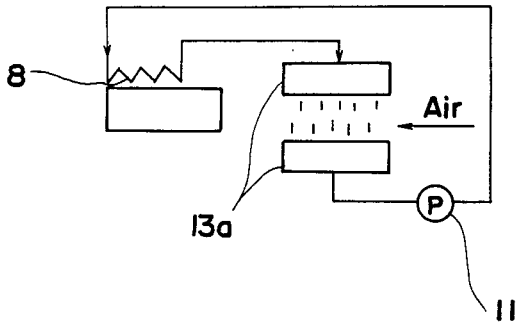
FIG. 9 is a schematic view of a cooling tower employed as a means for cooling an induction heating coil.
Figure 10:
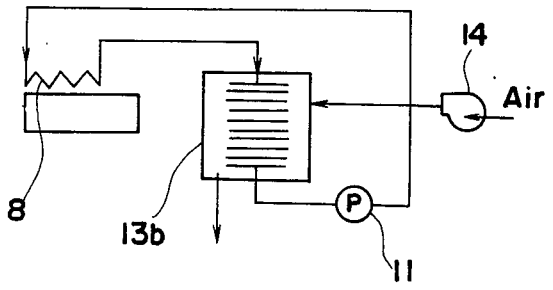
FIG. 10 is a schematic view of a fan coil employed as a means for cooling an induction heating coil.

The exhaust gas (primarily air containing water vapor) generated by the compacting apparatus is discharged after dust particles are removed therefrom by a filter. It is preferable from the standpoint of energy saving to employ the exhaust gas effectively.

Where the induction heating coil is used as the heating means 8, coil insulation is protected by a cooling medium such as cooling water since the coil insulation is effective below a temperature of 180° C. FIG. 9 shows a cooling system in which cooling water is used as a cooling medium, and FIG. 10 illustrates a cooling system in which a coolant with an antifreeze added is used as a cooling medium. In FIGS. 9 and 10, the cooling medium is circulated by a pump 11 through the induction heating coil 8 and a heat exchanger which comprises a cooling tower 13*a* (FIG. 9) or a fan coil 13*b* (FIG. 10). The fan coil 13*b* of FIG. 10 is cooled by a fan 14. The problems of the illustrated cooling systems are that where the cooling tower 13*a* is employed, the cost of installation is high, and where the fan coil 13*b* is used, the fan 14 should be added. These problems can be solved by the method of processing the exhaust gas according to the present invention.

The method of processing the exhaust gas will be described with reference to FIG. 11.

Figure 11:
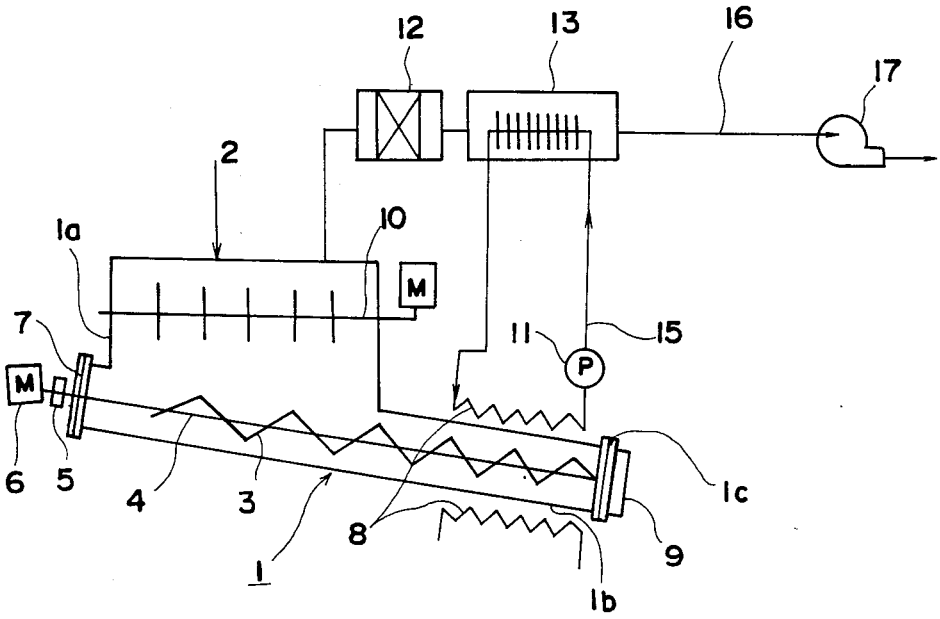
FIG. 11 is a schematic view explanatory of an accessory facility for processing an exhaust gas.

The facility shown in FIG. 11 includes an induction heating coil 8, a circulating pump 11, a filter 12, a heat exchanger 13, a circulating line 15 for passage of a cooling medium such as cooling water, an exhaust gas line 16, and an exhaust fan 17.

The exhaust gas generated by the compacting apparatus is drawn from the charging hopper 1*a* by the exhaust fan 17 on the exhaust gas line 16 into the heat exchanger 13 through the filter 12. The filter 12 removes dust particles produced chiefly by the chopper 10. The dust particles collected by the filter 12 can subsequently be solidified by the compacting apparatus. Therefore, no secondary waste material is produced by the exhaust gas processing facility.

The cooling water which has cooled the induction heating coil 8 is introduced through the line 15 into the heat exchanger 13. The exhaust gas is discharged out of the system after having cooled the cooling medium in the heat exchanger 13. The cooled cooling medium then flows through the line to cool the induction heating coil 8. The cooling medium may comprise a coolant with an antifreeze such as ethylene glycol added.

A method of cleaning the compacting apparatus according to the present invention will be described.

In the operation of the compacting apparatus, a solid waste material tends to be attached to or deposited in the hollow cylindrical body 1 and interferes with the compacting process in the cylindrical body 1. It is relatively difficult to discharge the remaining solid waste material out of the compacting apparatus.

Known methods of cleaning the compacting apparatus include a self-cleaning process, a substitute cleaning process, and a solvent cleaning process. The self-cleaning process is characterized in that the apparatus is so constructed as to prevent the solid waste from remaining in the apparatus, but the construction of the apparatus is rendered complex. The substitute cleaning process cleans the apparatus by supplying a clean substance to replace the remaining solid waste in the apparatus, but is disadvantageous in that a secondary waste is produced. The solvent cleaning process cleans the apparatus by solving the remaining waste with an organic solvent, but is costly and complex to carry out since the organic solvent or other cleaning agent is required.

The above problems can be eliminated by the cleaning method of the present invention. According to the cleaning method of the invention, a cleaning material is charged into the compacting apparatus to discharge the remaining solid waste out of the hollow cylindrical body.

The cleaning material may comprise a solid waste material itself to be processed by the compacting apparatus, or sand. Where the solid waste material is to be used as the cleaning material, the solid waste material being processed is directly employed as the cleaning material, and hence the cleaning operation is simplified and no additional equipment is required for cleaning the apparatus.

In the event of employing the solid waste material as the cleaning material, the remaining solid waste material should be discharged out at a temperature lower than the melting point of the plastics material contained in the solid waste material and higher than the temperature at which the solid waste material is kept in the flowing condition. If the heating temperature exceeded the melting point, then the viscosity of the remaining solid waste material would be too low to push out the remaining solid waste material. If the heating temperature were so low that the solid waste material would not be flowable, then the solid waste material would not flow and not completely be discharged out of the apparatus. The heating temperature is appropriately determined depending on the melting point of the solid waste material. If the melting point of the solid waste material is 190° C., then the heating temperature should range from 150° to 180° C. When the solid waste material is charged into the compacting apparatus in the above temperature range, the solid waste material is crushed and ground, and is rendered flowable, but not melted. Then, it is discharged with the remaining solid waste material from the compacting apparatus. Since the temperature is lowered, the melted remaining solid waste material can easily be discharged out of the apparatus due to an increased viscosity thereof.

After the charging of the solid waste material has been stopped, the screw blade 3 is rotated for a while to permit the remaining solid waste material to be completely discharged out of the compacting apparatus. In the cleaning process, the outlet nozzle 9 should be removed.

The solid waste material which has been charged to discharge the remaining solid waste material will then be solidified in the normal operation of the compacting apparatus. Therefore, no secondary waste material is produced in the cleaning process, and no additional cleaning equipment is required.

Where sand is used as the cleaning material, the solid waste material being compacted should be kept at the temperature to maintain the solid waste material flowable. Therefore, the apparatus can be cleaned easily under the normal temperature condition used when the apparatus is in normal operation. For example, if the melting point of the remaining solid waste material is 200° C., then the temperature should range from 160° to 250° C. in the cleaning operation.

Examples and Comparative Examples of the apparatus, facilities and methods of the present invention will hereinafter be described.

EXAMPLE 1

A compacting test was conducted using the compacting apparatus of the present invention.

1 $m^3$ of a rag, 0.7 $m^3$ of polypropylene pipes, 0.2 $m^3$ of wood, and 0.1 $m^3$ of high-efficiency particulate air (HEPA) filters, having the dimensions given in the Table 1, were mixed together, and 2.2 $m^3$ of polyethylene sheets was mixed with the above mixture. The resultant mixture was charged into the compacting apparatus shown in FIG. 1, which was operated at 16 r.p.m. and 250° C. The length of a hollow cylindrical body of the compacting apparatus used in this Example was 1.8 m (the length covering a freely movable bearing 7 and waste outlet 1*c* in FIG. 1) and the length of a heating portion 1*b* in FIG. 1 was about 0.9 m. The hollow cylindrical body was made of 6 inches tube of schedule 80 (ASTM).

TABLE 1

| Materials | HEPA filter | Rag | Polypropylene pipe | Wood |
|---|---|---|---|---|
| Dimensions before charging | 610 × 610 × 400 | 100–200 | 30 (diameter) × 200 (length) (mm) | 150 × 150 × 150 |

As a result, a strong and uniform solid mass was produced. The volume of the materials before being charged was 4.2 $m^3$, and the volume of the produced solid mass was 0.285 $m^3$. The remaining material in the compacting apparatus had a volume of 16 liters. Therefore, it was found that the ratio between the initial and compacted volumes is 1/14.

EXAMPLE 2 AND COMPARATIVE EXAMPLE 1

(Comparative Example 1)

A test was conducted for the method of controlling the compacting apparatus of the present invention. A piece of wood having the dimensions of 50×100×20 mm was charged into the compacting apparatus of FIG. 1 which rotated at 16.6 r.p.m., and seized by section A in FIG. 1 whereby section B of rotation shaft 4 in the same Figure was twisted.

(EXAMPLE 2)

Figure 12:
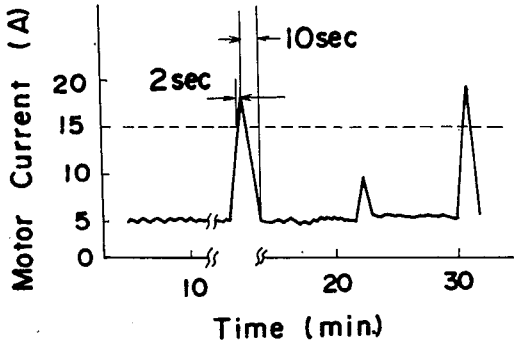
FIG. 12 is a graph showing the relationship between time intervals in which a motor rotates in normal and reverse directions and a motor current.

The shaft 4 was replaced in the same apparatus as that used in Comparative Example 1, and the apparatus was operated under the same conditions as those of Comparative Example 1. The wood piece was seized by the screw blade, and the motor was subjected to a heavy load. This condition was confirmed by the time-dependent change of the current shown in FIG. 12. 2 seconds after the current reached 15 A or more, the motor was reversed for 10 seconds, and the current dropped to a normal level. Continued operation of the compacting apparatus according to this control method resulted no twisting of the shaft and no damage to the screw blade.

EXAMPLE 3

A test was conducted for the production of a solid mass from a solid waste material, using the compacting apparatus shown in FIG. 1 and the apparatus shown in FIGS. 5 through 7 for producing solid masses from a solid waste material.

The shaping tube which had a square cross section (each side being 120 mm long), a tube length of 620 mm and a tube thickness of 6 mm was detachably attached at one end thereof to the outlet of the compacting apparatus. The presser plate was mounted on the piston and inserted by the fluid cylinder into the shaping tube in the vicinity of the outlet of the compacting apparatus, there being a clearance of 2 mm between the outer peripheral edge of the presser plate and the inner wall surface of the shaping tube.

Then, the waste material was charged into the compacting apparatus, and heated and kneaded for about 10 minutes. Thereafter, the pressure of the fluid cylinder was selected to be 10 kg/cm$^2$, and the compacted extruded mass was forced into the shaping tube. When the extruded mass reached the outlet of the shaping tube closer to the fluid cylinder, the shaft of the compacting apparatus was stopped, and then reversed for about three revolutions.

The shaping tube was detached from the outlet of the cylindrical body, and then was moved over toward the ejector assembly. The cooled extruded mass was ejected as a solid mass by the ejector piston.

EXAMPLES 4 AND 5

The method of cleaning the compacting apparatus of the invention was tested.

(EXAMPLE 4)

After the compacting apparatus shown in FIG. 1 operated, 16 kg of a remaining solid waste material was left in the hollow cylindrical body of the apparatus. In order to clear away the remaining solid waste material with the solid waste material newly charged, the interior of the hollow cylindrical tube was heated up to 150° C. (which is below the melting point of polyethylene). When 5 kg of a solid waste material was charged into the inlet hopper, 20.0 kg of the solid waste material was discharged from the outlet.

As a consequence, it was found that 1 kg of the solid waste material was finally left in the compacting apparatus, and the percentage of the remaining material in the compacting apparatus according to the cleaning method of the invention was 6%.

(EXAMPLE 5)

138 kg of a solid waste material was charged into the hollow cylindrical body while it was heated to 250° C. and the shaft was rotated at 6 r.p.m., and as a result 122 kg of a solid mass was discharged. Then, 20 kg of sand was charged into the hollow cylindrical body as it was still heated in order to remove the remaining solid waste material. The remaining solid waste material and sand, totalling 35.68 kg, were discharged. Therefore, the percentage of the remaining material was 2%.

Although certain preferred embodiments have been shown and described, it should be understood that many changes and modifications may be made therein without departing from the scope of the appended claims.

The apparatus for compacting a solid waste material according to the present invention may further comprise at least one of accessory facilities respectively for controlling rotation of the rotatable shaft, producing a solid mass and processing an exhaust gas from said apparatus.

What is claimed is:

1. An apparatus for compacting a solid waste material comprising radioactive material including a thermoplastic material, comprising:

(a) a hollow cylindrical body having a charging inlet for charging the solid waste material therethrough into the hollow cylindrical body, a heating portion for heating the solid waste material in said hollow cylindrical body, and a discharging outlet for discharging the solid waste material from said hollow cylindrical body;

(b) a rotatable shaft disposed in said hollow cylindrical body and having a helical screw blade thereon, said screw blade and an inner wall surface of said hollow cylindrical body being spaced from each other with a clearance provided therebetween for allowing the solid waste material in said hollow cylindrical body to form a bridge therein;

(c) support means for radially movably supporting an end of said rotatable shaft;

(d) a prime mover coupled to said end of the rotatable shaft through said support means; and (e) an outlet nozzle coupled to said discharging outlet for compressing the solid waste material discharged from said discharging outlet.

2. An apparatus according to claim 1, wherein said hollow cylindrical body is inclined downwardly toward said discharging outlet at an angle smaller than the angle of repose of the solid waste material including a plastics material.

3. An apparatus according to claim 1, wherein said clearance ranges from 5 to 20 mm with said rotatable shaft and said hollow cylindrical body being coaxial with each other.

4. An apparatus according to claim 1, wherein said outlet nozzle has a cross section which is substantially the same as that of said hollow cylindrical body.

5. An apparatus according to claim 1, wherein said screw blade has a substantially half distal end portion inclined toward said end of the rotatable shaft between said charging inlet and said heating portion.

6. An apparatus according to claim 1, wherein said screw blade has at least one recess between said charging inlet and said heating portion.

7. An apparatus according to claim 1, further comprising an accessory facility for controlling rotation of said rotatable shaft depending on a current flowing through said prime mover or a torque imposed on said prime mover.

8. An apparatus according to claim 7, wherein in the accessory facility said rotatable shaft is rotated in a reverse direction for a preset interval of time when said current or torque exceeds a predetermined level.

9. An apparatus according to claim 8, wherein in the facility the number of reverse rotations of said rotatable shaft is counted, and the rotation of said rotatable shaft is stopped when the counted number reaches a given one within a given period of time.

10. An apparatus according to claim 9, wherein the operation of a chopper disposed at said charging inlet is stopped at the same time that the rotation of said rotatable shaft is stopped.

11. An apparatus according to claim 1, further comprising an accessory facility for producing a solid mass comprising:

(a) a plurality of shaping tubes into each of which an extruded mass from said compacting apparatus can be forcibly charged;

(b) means for closing one of said shaping tubes at a time when the extruded mass is charged into said one shaping tube;

(c) means for moving said shaping tubes in a direction; and (d) means spaced from said compacting apparatus in said direction for ejecting the extruded mass out of said one shaping tube.

12. An apparatus according to claim 11, wherein in the facility each of said shaping tubes is of a rectangular cross section.

13. An apparatus according to claim 11 wherein in the facility said closing means comprises a presser plate having an outer periphery substantially identical in shape to an inner peripheral surface of said shaping tube, a piston on which said presser plate is mounted, and a fluid cylinder for moving said piston under a prescribed fluid pressure to displace said presser plate in said shaping tube.

14. An apparatus according to claim 11, wherein in the facility said ejecting means comprises a piston for ejecting the extruded mass out of said shaping tube, and a fluid cylinder for moving said piston.

15. An apparatus according to claim 1, further comprising an accessory facility for producing a solid mass comprising the means of:

(a) positioning a shaping tube with an end thereof opening toward said discharging outlet;

(b) closing an opposite end of said shaping tube with closing means;

(c) forcibly charging an extruded mass from said apparatus into said shaping tube;

(d) thereafter rotating said rotatable shaft in a reverse direction to cut off said extruded mass in the vicinity of said discharging outlet;

(e) moving over said shaping tube filled with said extruded mass to cool the same; and (f) ejecting the shaped and cooled extruded mass out of said shaping tube.

16. An apparatus according to claim 15, wherein in the facility said shaping tube is of a rectangular cross section.

17. An apparatus according to claim 15 or 16, wherein in the facility said closing means comprises a presser plate having an outer periphery substantially identical in shape to an inner peripheral surface of said shaping tube, a piston on which said presser plate is mounted, and a fluid cylinder for moving said piston under a prescribed fluid pressure to displace said presser plate in said shaping tube.

18. An apparatus according to claim 1, further comprising an accessory facility for processing an exhaust gas from an apparatus for compacting a solid waste material including a plastics material, said facility comprising the means of:

(a) filtering the exhaust gas produced by said compacting apparatus to collect dust particles therefrom;

(b) thereafter discharging the exhaust gas through an exhaust gas line; and (c) cooling a cooling medium for said induction heating coil with said exhaust gas in a heat exchanger disposed on said exhaust gas line.

19. An apparatus according to claim 18, wherein in the facility said cooling medium comprises water or a coolant with an anti-freeze added thereto.

20. A method of cleaning an apparatus for compacting a solid waste material comprising radioactive material including a plastics material, said apparatus comprising a hollow cylindrical body having a charging inlet for charging the solid waste material therethrough into the hollow cylindrical body, a heating portion for heating the solid waste material in said hollow cylindrical body, and a discharging outlet for discharging the solid waste material from said hollow cylindrical body; a rotatable shaft disposed in said hollow cylindrical body and having a helical screw blade thereon, said screw blade and an inner wall surface of said hollow cylindrical body being spaced from each other with a clearance provided therebetween for allowing the solid waste material in said hollow cylindrical body to form a bridge therein; support means for radially movably supporting an end of said rotatable shaft; a prime mover coupled to said end of the rotatable shaft through said support means; and an outlet nozzle coupled to said discharging outlet for compressing the solid waste material discharged from said discharging outlet, said method comprising the step of:

(a) charging a solids cleaning material into said hollow cylindrical body to force a remaining solid waste material out of said hollow cylindrical body.

21. A method according to claim 20, wherein said cleaning material is said solid waste material and said remaining solid waste material is forced out thereby at a temperature lower than the melting point of said solid waste material and higher than the temperature at which said solid waste material remains flowable.

22. A method according to claim 20, wherein said cleaning material is sand.

23. A method according to claim 22, wherein when said sand is charged as the cleaning material, said remaining solid waste material is forced out thereby at a temperature higher than the temperature at which said solid waste material remains flowable.

* * * * *